US012011080B2

(12) United States Patent
Duquet

(10) Patent No.: US 12,011,080 B2
(45) Date of Patent: Jun. 18, 2024

(54) PARTICULARLY EASY TO PRODUCE COSMETIC UNIT

(71) Applicant: GEKA GmbH, Bechhofen (DE)

(72) Inventor: Frederic Duquet, Crespières (FR)

(73) Assignee: GEKA GMBH, Bechhofen (DE)

( * ) Notice: Subject to any disclaimer, the term of this patent is extended or adjusted under 35 U.S.C. 154(b) by 0 days.

(21) Appl. No.: 17/921,460

(22) PCT Filed: Apr. 12, 2021

(86) PCT No.: PCT/EP2021/059400
§ 371 (c)(1),
(2) Date: Oct. 26, 2022

(87) PCT Pub. No.: WO2021/219354
PCT Pub. Date: Nov. 4, 2021

(65) Prior Publication Data

US 2023/0200518 A1 Jun. 29, 2023

(30) Foreign Application Priority Data

Apr. 28, 2020 (DE) ..... 202020102376.4

(51) Int. Cl.
*A45D 40/26* (2006.01)
*A45D 40/00* (2006.01)

(52) U.S. Cl.
CPC ..... *A45D 40/267* (2013.01); *A45D 40/0087* (2013.01); *A45D 40/265* (2013.01); *A45D 2200/05* (2013.01); *A45D 2200/1045* (2013.01)

(58) Field of Classification Search
CPC ..... A45D 40/265; A45D 40/267; A45D 40/0087; A45D 2200/1045
See application file for complete search history.

(56) References Cited

U.S. PATENT DOCUMENTS 5,862,818 A * 1/1999 Marinelli ..... B65D 51/32 206/229
6,343,887 B1 * 2/2002 Dumler ..... A46B 7/04 401/122

(Continued)

FOREIGN PATENT DOCUMENTS

| | | |
|---|---|---|
| JP | 2012179103 A | 9/2012 |
| JP | 2002238655 A | 8/2022 |
| KR | 101309873 B1 | 9/2013 |

OTHER PUBLICATIONS

International Search Report issued Jun. 23, 2021 in corresponding International Application No. PCT/EP2021/059400.

*Primary Examiner* — Jennifer C Chiang
(74) *Attorney, Agent, or Firm* — GLOBAL IP COUNSELORS, LLP

(57) ABSTRACT

A preform for a cosmetic unit filled with cosmetic mass has a container part which preferably forms a tube. The tube is open on the underside and is dimensioned in such a way that, after filling with the cosmetic mass to be stored by it, it can be closed by welding without being affected by the cosmetic mass and then forms to form the complete cosmetic container. The container part providing provides a subsequent removal opening on the upper side, and an applicator part, which consists at least of includes a stem fitted or capable of being fitted with an applicator element. The stem of the preform being is arranged partly inside the container part and partly projecting outwards through the subsequent removal opening. The stem is connected via a thin material bridge to the inner edge of the subsequent removal opening in such a way that it closes to close the latter tightly. The stem and the container part are an integral one-piece component.

14 Claims, 1 Drawing Sheet

(56) References Cited

U.S. PATENT DOCUMENTS 6,505,631 B2 * 1/2003 Fischer ..... A45D 40/267
401/122
8,337,108 B2 * 12/2012 Bouix ..... A45D 40/265
401/133

* cited by examiner

PARTICULARLY EASY TO PRODUCE COSMETIC UNIT

CROSS-REFERENCE TO RELATED APPLICATION

This application is a U.S. National Stage application of International Application No. PCT/EP2021/059400, filed Apr. 12, 2021, which claims priority to German Patent Application No. 202020102376.4, filed Apr. 28, 2020, the contents of each of which are hereby incorporate by reference.

BACKGROUND

Field

The present disclosure concerns a preform for the particularly simple and rational production of a cosmetic unit and a cosmetic unit produced from it. In addition, a corresponding process is also described herein.

Background Information

With increasing competitive pressure, there is a growing need to be able to spontaneously communicate to the public at trade fairs what special application experience a certain new type of cosmetic and/or a certain new type of cosmetic applicator offers. Anyone who distributes a large number of free, marketable cosmetic units with a not inconsiderable filling quantity at a trade fair risks first of all clogging up the targeted market himself.

Another important aspect to consider is cost. To save costs, simplified cosmetic units are increasingly being produced for demonstration and testing purposes. These are designed to offer the same application experience as the original, marketable product that serves as a model. Due to their simpler design and lower filling, they can be disposed of promptly after testing with a clear conscience.

Various constructions are available that did not solve the issues.

SUMMARY

For example, there have been cosmetic units manufactured on a tubular bag basis. In cosmetic units of this type, the fixed cosmetic container has been replaced by a tubular bag. A rigid bottle neck has been welded into the tubular bag. A cosmetic applicator of known design with a cap, stem and an applicator element carried by it is then screwed or snapped onto this bottle neck.

Unlike a firm, easy-to-grip bottle, however, the soft tubular bag lies poorly in the hand during use. The user must always take care that the tubular bag does not collapse unintentionally. He or she must also make sure that even in the event of a temporary inattention no too firm pressure is exerted on the tubular bag. Otherwise, cosmetic mass can accidentally leak out and possibly lead to soiling. This is the reason why such tubular bag-based packaging does not meet with a very high level of acceptance from the public. They could therefore not be accepted for the purpose discussed here.

Alternatively, it has already been considered to use a simple tray closed with a foil instead of a container. The foil can be easily removed. Then the applicator and the tray can be used together like a brush and a palette. In this way the cosmetic mass stored in the tray can be applied easily and without soiling.

However, this type of tester or this type of unit has also not really caught on. On the one hand, this is because the tray or its use as a pallet creates a completely different application experience—compared to the usual application of the cosmetic from the rigid bottle, which is familiar to most test persons. Another reason why the tray has not been accepted is that it is relatively difficult to keep an applicator in the tray together with the cosmetic mass that way that the applicator remains clean and virginal until the first use. Special, and therefore complicated, precautions have to be taken here. This is the only way to ensure that the cosmetic mass remains strictly in the area of the tray assigned to it. Under no circumstances must the cosmetic mass penetrate into the storage area of the applicator. This is the only way to guarantee that the testing person can precisely guide the applicator during testing without inadvertently bringing cosmetic mass to the fingers.

In light of the above, the invention is based on the task of creating a cosmetic unit, whose application behaviour on the one hand deviates as little as possible from the known cosmetic units with their rigid, bottle-like storage container, and which, on the other hand, can be produced much more efficiently and thus more cost-effectively.

The solution according to one aspect of the disclosure is achieved by using a preform to be transformed into a bottle-like container in a subsequent production step, as described herein.

The preform forms the basis for the production of a cosmetic unit filled with cosmetic mass. The preform comprises a container section which is open on its side facing away from the subsequent removal opening. This part of the container, which is open on the underside, forms a tube—preferably essentially dimensionally stable in itself. This tube is dimensioned in such a way that after filling with the cosmetic mass to be stored by it, it can be sealed tightly by inner sealing without being affected by the cosmetic mass. After closing, the tube forms the complete cosmetic container. An additional part, such as a separately produced base of the bottle, which is therefore expensive to install and finally to be welded to the tube, is usually not required. In most cases, no filler metal is required, i.e. additional material to be added during welding to bridge the gap.

The container part, which is part of the preform, provides a later removal opening at the top. However, the later removal opening is initially still hermetically closed and thus sealed.

The Preform also includes an applicator section. This consists at least of a stem which is equipped or can be equipped with an applicator element. The applicator element is formed by a bristle carrier and bristles (or bristle replacing elements) which normally project radially from it. The applicator element can be a one-piece applicator element produced by injection moulding. Alternatively, a so-called "twisted-wire brush" is used.

The stem of the preform is partly located inside the container part. Partly it protrudes outwards through a later removal opening.

The decisive factor is that the stem is connected to the edge of the subsequent removal opening via a thin section in such a way that it seals the removal opening tightly, but can be separated from its edge without the use of tools—simply by vigorous pulling or pressing. The handle and the container part are an integral, one-piece component until the cosmetic unit is opened. As a rule, this integral one-piece component is produced in one shot and from a homogeneous material by plastic injection moulding.

Such a preform allows a very rational production of a finished cosmetic unit. The applicator element is easy to install due to the initially still open base, which forms an easily accessible, free loading opening—provided that the applicator element has not already been moulded on during the injection moulding step forming the preform. Subsequently, the large loading opening allows the cosmetics load intended for the cosmetic unit to be inserted or even injected with simple means. There is no need for a special trunk which first has to be pushed through a narrow bottle neck into the interior of the cosmetics container in order to fill it with the amount of cosmetic mass measured to it.

Then only the tube needs to be flattened. Afterwards it can be sealed by welding "with itself". This completes the cosmetic unit.

The procedure according to one aspect of the disclosure is much simpler than

- first produce a bottle separately,
- equip the bottle with a separate wiper,
- to fill the bottle through the narrow bottle neck,
- to then insert the applicator, which is also manufactured separately, into the bottle together with a large part of the stem carrying it
- and tightly screwing or snapping the applicator onto the bottle
- and then to apply a special seal to ensure that the contents of the cosmetic unit cannot be tampered with unnoticed before opening Starting from the basic idea described herein, one embodiment of the invention can be further improved or refined step by step, for example in the outline of what follows.

It is particularly advantageous if the stem is not already connected with its slender diameter directly to the edge of the later removal opening. Instead, the connection is made via a first plate extending radially outwards from the slender portion of the stem. The plate is usually flat and disc-shaped. It closes off the later removal opening. It does this by being connected to the inner edge of the later removal opening via a thin section. By dimensioning the radial extension of the plate it is very easy to control how large the clear diameter of the later removal opening is. This is important because the clear opening created by the tearing-off of the plate should also serve as a wiper for the applicator element's trimming formed by the applicator organs. The clear diameter of the removal opening resulting from the tearing must therefore not be too small. Instead, it must be exactly matched to the maximum outside diameter that the facing of the applicator element shows.

It is advisable to form the thin section by which the stem is connected to the inner edge of the later removal opening by a v-shaped circumferential annular groove. Its v-opening faces the interior of the container part. The bottom of the groove is the thinnest point here. A strong notch effect occurs at the bottom of the groove. For this reason, the bottom of the groove can be used as a thin point which can be broken open with little effort and very well reproducibly.

Such a v-shaped groove, which is open inwards, i.e. towards the inside of the container part, has the great advantage that after the cosmetic unit has been broken open at the container part, it leaves a cone tapering from the inside of the container part towards the outside. Such a cone forms a very effective, integrated wiper if its diameter is correctly designed. It is no longer necessary to press a separate wiper into the bottle neck and fix it there—as is otherwise known from classic cosmetics bottles. This saves considerable costs.

A particularly favourable option is to equip the handle with a plate whose outer diameter is larger than the maximum clear inner diameter of the removal opening after breaking. Such a plate is usually a second, additional plate. It is then arranged next to the first plate, which seals the removal opening until it is broken open. In this case, the said (possibly second) plate and the diameter of the removal opening created with the opening are matched to each other. The coordination is such that the said plate can be forced through the removal opening despite its radial oversize, with essentially elastic expansion of the removal opening. This elastic expansion is supported by the conical shape of the removal opening. The said second plate then rests from the inside against the inner surface of the container part surrounding the withdrawal opening. This is the case, in any case, if it is ensured that this forcing of the said plate into the container results in a permanent elastic force which tends to push the stem outwards again through the sampling opening.

Further design possibilities, modes of action and advantages of one embodiment of the invention result from the following description of the preferred design example using the figures.

It is important to note that protection for the inventive manufacturing method will also be claimed in due course.

BRIEF DESCRIPTION OF THE DRAWINGS

This invention will be explained in more detail hereinafter with reference to the drawings.

FIG. 1 shows very clearly the preform 1, which forms the basis for the production of a ready-to-use cosmetic unit filled with cosmetic mass, which at the same time also provides an applicator element 2 for convenient application according to an embodiment of the present disclosure.

Figure 1:
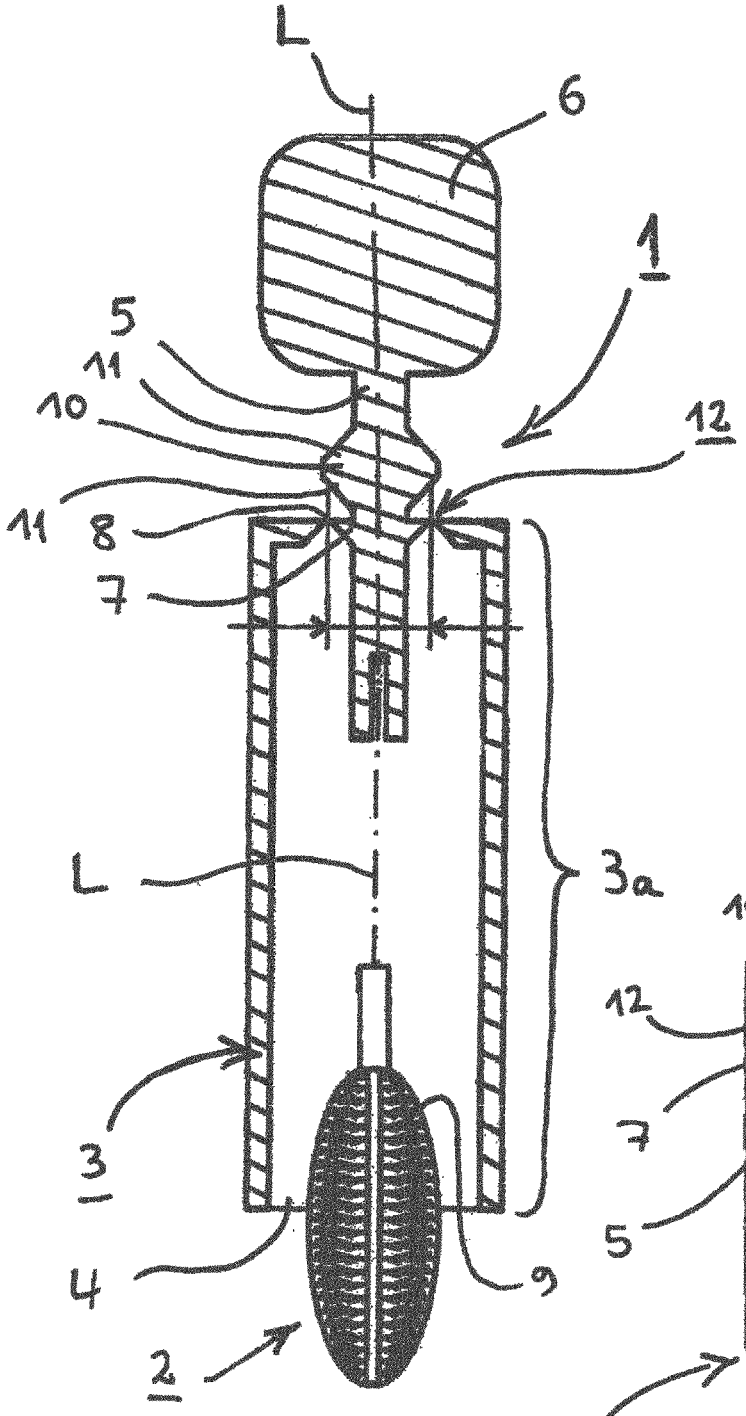
FIG. 1 shows an exploded view of the unfilled and unsealed preform and the applicator element to be combined with it according to an embodiment of the present disclosure.

Typical materials for preform 1 are HDPE or high-quality functional plastics, such as those traded under the HYTREL brand. Alternatively, nylon or comparable materials can also be used. The plastics are in any case resistant to cosmetics. They are therefore not attacked by cosmetics and the waxes and/or lipids contained in them or even cause them to swell.

Preform 1, according to an embodiment of the present disclosure, consists of a container section or part 3, which is open at the bottom. It therefore has a free loading opening 4 on its underside. In the present case, the predominant part of the container part 3 is formed by a tube 3*a*. The tube 3*a* is preferably essentially dimensionally stable in itself. The term "essentially dimensionally stable in itself" means that the tube 3*a* essentially retains its shape as long as no external forces are applied which compress the tube 3*a*. In this respect the tube 3*a* differs from a film. A film is typically almost completely flexible. It therefore collapses unless it is inflated by its contents or by internal pressure, I.

In the uncompressed state, the cross-section of tube 3*a* is preferably—at least essentially—circular or oval according to an embodiment of the present disclosure. The wall thickness of tube 3*a* is typically more than 0.3 mm according to an embodiment of the present disclosure. In some cases, it is even more than 0.5 mm.

The length of the tube 3*a* in the direction parallel to the longitudinal axis L of the stem is selected to match the filling quantity or vice versa according to an embodiment of the present disclosure. This ensures that the tube 3*a* can be compressed and welded at its previously open end even after filling, without cosmetic material being squeezed up to the area to be welded and then causing problems during welding. After all, a perfect weld—that is really tight—can only be guaranteed if the area to be welded does not come into contact with cosmetic mass before welding.

As one can see, a stem 5 is integrally connected to the container part 3 in one piece according to an embodiment of the present disclosure. It is advisable that the stem 5 merges integrally into a handle 6 on its side outside the container part 3. The handle 6 is typically designed as a flat plate, with a plate thickness of usually between 3 mm and 10 mm. This avoids material accumulations which lead to unsightly collapse of the surface during cooling.

As can be seen, a part of the stem 5 is inside the container part 3 from the beginning (i.e. already during the original forming process) according to an embodiment of the present disclosure. This part of the stem is usually the larger or longer part compared to the other part of the stem which is outside the container part 3.

The special feature here is that the stem together with the container part 3 forms a one-piece integral preform 1 according to an embodiment of the present disclosure.

As one can see from FIG. 1, the stem 5 here has a first plate 7. This plate 7 extends all around in radial direction away from the style. In the area of its largest outer diameter, the first plate 7 is integrally connected to the container part 3 by a thin material bridge. To put it in slightly different terms, it can be said that the container part 3 and the first plate 7 together form a circular ring groove which is open towards the inside of the container part 3. In this case it is a V-shaped groove. The bottom of the groove forms a thin section or a thin material bridge. The first plate 7 and the container part 3 are integrally connected to each other in one piece via this thin bridge—as long as the stem 5 with its first plate 7 has not been separated from the container part 3 by a bold pulling movement or a bold pushing in and the destruction of the thin bridge.

As can be clearly seen from FIG. 1, one sloping flank of the v-shaped circular ring groove is part of the first plate 7. The other sloping flank of the v-shaped circular ring groove on the opposite side is part of container part 3. After the first plate 7 has been torn off, the said sloping flank borders the now free removal opening of container part 3. In most cases, each sloping flank of the v-shaped groove towards the inside of the container encloses an angle of approx. 40° to 50° with the longitudinal axis L of the stem 5.

The removal opening freed up by the tearing off has a maximum clear diameter which is usually—at least in some areas—smaller than the maximum outside diameter of the trim which the applicator element 2 carries. As a result, the removal opening freed by the tearing off acts as a wiper for the trim formed by the individual applicator elements, which are preferably designed as bristles. The wiping effect of the removal opening is essentially supported by the fact that the container part 3, which borders it, forms a cone which narrows from the inside of the container part 3 to the outside.

Figure 2:
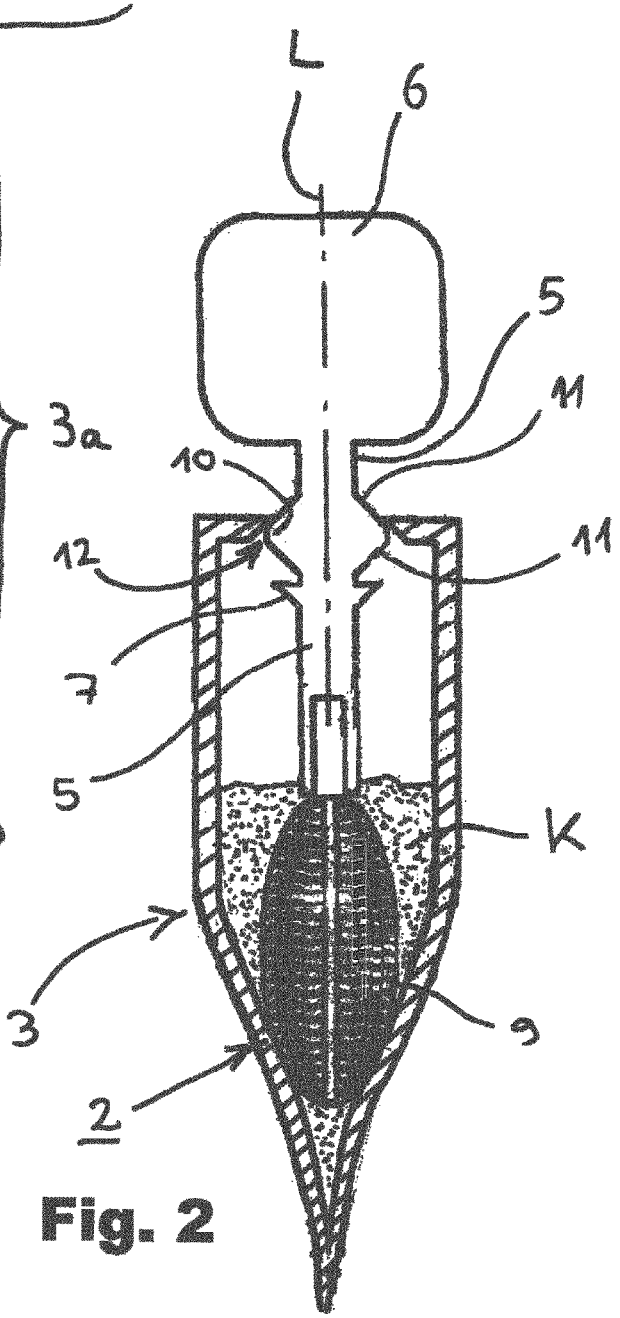
FIG. 2 shows the cosmetic unit produced with the aid of the preform, after opening, in a ready-to-use state, but already tightly closed again according to an embodiment of the present disclosure.

FIG. 2 shows the ready-to-use cosmetic unit according to an embodiment of the present disclosure. As one can see, cosmetic mass K has been filled in through the free loading opening. The preform has usually been turned upside down compared to the position shown in the figure.

Then tube 3 has been compressed in an area of the free loading opening 4 according to an embodiment of the present disclosure. The compression was carried out in such a way that opposite tube walls came to rest against each other at the outermost (here lower) end. The tube walls which are in contact with each other were then welded together.

FIG. 2 shows the cosmetic unit after being opened according to an embodiment of the present disclosure.

As one can see, the first plate 7 here has already been separated from the container part 3 by breaking open the thin material bridge 8. It is easy to see how the cosmetic unit can still be closed cleanly.

The stem 5 has a second plate 10 on its side facing away from the applicator element 2, i.e. above the first plate 7. This second plate 10 is preferably provided with a bevel 11 on both sides. It is easy to see that the maximum outside diameter of the second plate 10 is in any case larger than that of the first plate 7. Due to the elasticity of the materials used here, the second plate 10 can still be forced through the removal opening 12 that has become free due to the tearing-off of the first plate 7.

In the embodiment shown in FIG. 2, the applicator organs 9 of the applicator element 2 come to rest on the inside of the container part 3, which narrows at the bottom due to the welding. They try to push the stem upwards again. This does not succeed. This force, however, presses the top-side bevel on the second plate 10 against the cone of the wiper in a well closing manner. This enables a sufficiently tight connection.

Instead of using the applicator organs to generate the pre-tension just described, a different spring element not shown here figuratively can be used according to an embodiment of the present disclosure.

In general, with regard to subsequent patent applications, protection is also claimed for a method for manufacturing a cosmetic unit. In any case, the inventive method is characterized by the fact that first a preform according to one of claims 1 to 10 is produced, preferably by injection moulding, that (preferred) subsequently the applicator element equipped with applicator organs is inserted into the container through the still open bottom of the container and connected to the free end of the stem located there, whereupon the cosmetic mass to be stored by the container is filled through the still open bottom of the container in such a way that the sections of the container bordering the open bottom can now be pressed flat and placed against each other without coming into contact with the cosmetic and then tightly welded together.

The procedure can be further refined by the further disclosure content of the claims already established or the description, if necessary step by step.

The invention claimed is:

1. A preform for a cosmetic unit filled with cosmetic mass, having a container part which preferably forms a tube, is open on the underside and is dimensioned in such a way that, after filling with the cosmetic mass to be stored by the tube, the tube can be closed by welding without being affected by the cosmetic mass and then forms the complete cosmetic container, the container part providing a subsequent removal opening on the upper side, and an applicator part, which consists at least of a stem fitted or capable of being fitted with an applicator element, the stem of the preform being arranged partly inside the container part and partly projecting outwards through the subsequent removal opening, wherein the stem is connected via a thin material bridge to the inner edge of the subsequent removal opening in such a way that the stem closes the latter subsequent removal opening tightly, and the stem and the container part are an integral one-piece component, the stem forming a first plate extending radially outwards, which closes the subsequent removal opening and is connected to the inner edge of the subsequent removal opening via the thin material bridge.

2. A preform according to claim 1, characterized in that said thin material bridge is part of a preferably v-shaped, circumferential annular groove, the opening of which faces the interior of the container part.

3. A preform according to claim 2, characterized in that one side wall of the groove is an integral part of the stem or its first plate and the other side wall of the groove is an integral part of the container part.

4. A preform according to claim 2 characterized in that the bottom of the groove is the thin material bridge which allows the user to break open the "ready for use" cosmetic unit by removing the one-piece nature of the stem and the container part.

5. A preform according to claim 1, characterized in that the clear diameter of the removal opening, which is produced in the course of opening, is smaller than the outer diameter of the applicator trim, so that the applicator trim is wiped off when the removal opening is passed.

6. A preform according to claim 1, characterized in that the edge of the removal opening defining the inside diameter of the removal opening forms a cone which becomes narrower from the inside of the container part towards the outside thereof.

7. A preform according to claim 1, characterized in that the stem has one and preferably a second plate, the outer diameter of which is larger than the maximum clear inner diameter of the removal opening, wherein said plate and the removal opening are coordinated with each other so that said plate can still be forced through the removal opening and then sealingly abut from the inside against the inner surface of the container part surrounding the removal opening.

8. A preform according to claim 7, characterized in that said plate has a bevel on its upper and lower sides, preferably at an angle of between 30° and 50° to the longitudinal axis of the stem and ideally extending from the maximum outer circumference of the plate to directly adjacent the stem.

9. A preform according to claim 1 characterized in that the stem has a coupling for coupling an applicator element fitted with applicator members, the coupling being such that the applicator element can be coupled to the stem through the underside opening of the container part and thus permanently fixed there.

10. A preform according to claim 1, characterized in that the end of the stem outside the container part is integrally formed in one piece with a handle, preferably in the form of a plate which protrudes radially from the stem on two opposite sides.

11. Cosmetic unit with a container filled with cosmetic composition, in which an applicator with a stem and an applicator element carried thereby is inserted, the applicator sealing the container tightly and the container being tightly welded on its side facing away from the subsequent removal opening, characterized in that the cosmetic unit comprises a preform according to claim 1.

12. A cosmetic unit according to claim 10, characterized in that the container part forms a substantially inherently dimensionally stable tube which has been pressed flat (only) at its open end and welded into itself.

13. A preform for a cosmetic unit filled with cosmetic mass, having a container part which preferably forms a tube, is open on the underside and is dimensioned in such a way that, after filling with the cosmetic mass to be stored by the tube, the tube can be closed by welding without being affected by the cosmetic mass and then forms the complete cosmetic container, the container part providing a subsequent removal opening on the upper side, and an applicator part, which consists at least of a stem fitted or capable of being fitted with an applicator element, the stem of the preform being arranged partly inside the container part and partly projecting outwards through the subsequent removal opening, wherein the stem is connected via a thin material bridge to the inner edge of the subsequent removal opening in such a way that the stem closes the subsequent removal opening tightly, and the stem and the container part are an integral one-piece component, the stem having one and preferably a second plate, the outer diameter of which being larger than the maximum clear inner diameter of the removal opening, wherein said plate and the removal opening are coordinated with each other so that said plate can still be forced through the removal opening and then sealingly abut from the inside against the inner surface of the container part surrounding the removal opening.

14. A preform for a cosmetic unit filled with cosmetic mass, having a container part which preferably forms a tube, is open on the underside and is dimensioned in such a way that, after filling with the cosmetic mass to be stored by the tube, the tube can be closed by welding without being affected by the cosmetic mass and then forms the complete cosmetic container, the container part providing a subsequent removal opening on the upper side, and an applicator part, which consists at least of a stem fitted or capable of being fitted with an applicator element, the stem of the preform being arranged partly inside the container part and partly projecting outwards through the subsequent removal opening, wherein the stem is connected via a thin material bridge to the inner edge of the subsequent removal opening in such a way that the stem closes the subsequent removal opening tightly, and the stem and the container part are an integral one-piece component, the stem having one and preferably a second plate, the outer diameter of which being larger than the maximum clear inner diameter of the removal opening, wherein said plate and the removal opening are coordinated with each other so that said plate can still be forced through the removal opening and then sealingly abut from the inside against the inner surface of the container part surrounding the removal opening, and said plate having a bevel on its upper and lower sides, preferably at an angle of between 30° and 50° to the longitudinal axis of the stem and ideally extending from the maximum outer circumference of the plate to directly adjacent the stem.

* * * * *